US009914607B2

(12) United States Patent
Yamaguchi

(10) Patent No.: US 9,914,607 B2
(45) Date of Patent: Mar. 13, 2018

(54) SHEET CONVEYOR AND IMAGE RECORDING APPARATUS

(71) Applicant: BROTHER KOGYO KABUSHIKI KAISHA, Nagoya-shi, Aichi-ken (JP)

(72) Inventor: Masatomo Yamaguchi, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/418,070

(22) Filed: Jan. 27, 2017

(65) Prior Publication Data

US 2017/0217703 A1 Aug. 3, 2017

(30) Foreign Application Priority Data

Jan. 29, 2016 (JP) ..... 2016-016714

(51) Int. Cl.
*B65H 5/36* (2006.01)

(52) U.S. Cl.
CPC ..... *B65H 5/36* (2013.01); *B65H 2402/44* (2013.01); *B65H 2402/45* (2013.01); *B65H 2601/11* (2013.01)

(58) Field of Classification Search
CPC ..... B65H 2402/441; B65H 2404/45; B65H 2405/354; B65H 2407/21; B65H 2061/11; G03G 21/1633; G03G 2221/169; G03G 2215/00544; G03G 2215/00392
See application file for complete search history.

(56) References Cited

U.S. PATENT DOCUMENTS 6,830,400 B2 * 12/2004 Yerg nson ..... B41J 29/023 400/646
7,486,907 B2 * 2/2009 Noguchi ..... G03G 21/1853 399/110
7,606,512 B2 * 10/2009 Ukai ..... G03G 21/1647 399/110
7,682,096 B2 * 3/2010 Matsushima ..... B41J 29/02 399/401
7,917,062 B2 * 3/2011 Shin ..... G03G 15/657 399/124
8,087,658 B2 * 1/2012 Ohtsuki ..... B65H 5/26 271/162

(Continued)

FOREIGN PATENT DOCUMENTS

JP 5-66619 A 3/1993
JP 2008-100806 A 5/2008

(Continued)

*Primary Examiner* — Jeremy R Severson
(74) *Attorney, Agent, or Firm* — Merchant & Gould P.C.

(57) ABSTRACT

A sheet conveyor includes: a housing defining a conveyance path and a first side surface having an opening; a cover; a shaft defining a pivot axis of the cover and inserted in an elongated hole; and a limiter provided at the housing and having a contact surface that contacts the cover pivoted from a standing position to a lower position. The contact surface has a first end and a second end that is nearer to the conveyance path than the first end. The contact surface is inclined with respect to a horizontal direction such that the first end is located below the second end. The elongated hole permits the cover to move in such a direction that a pivoting distal end of the cover moves away from the opening, with the cover being in contact with the contact surface.

11 Claims, 10 Drawing Sheets

(56) References Cited

U.S. PATENT DOCUMENTS

| | | | | |
|---|---|---|---|---|
| 9,268,287 | B2 * | 2/2016 | Maruyama | G03G 15/6529 |
| 9,323,211 | B2 * | 4/2016 | Matsuno | G03G 21/1633 |
| 2006/0093397 | A1 * | 5/2006 | Yamaoka | G03G 15/165 399/110 |
| 2014/0340460 | A1 * | 11/2014 | Sugizaki | B65H 5/26 347/179 |
| 2015/0248105 | A1 * | 9/2015 | Aoi | G03G 21/1633 399/110 |

FOREIGN PATENT DOCUMENTS

| | | | |
|---|---|---|---|
| JP | 2011-235986 | A | 11/2011 |
| JP | 2015-110471 | A | 6/2015 |

* cited by examiner

SHEET CONVEYOR AND IMAGE RECORDING APPARATUS

CROSS REFERENCE TO RELATED APPLICATION

The present application claims priority from Japanese Patent Application No. 2016-016714, which was filed on Jan. 29, 2016, the disclosure of which is herein incorporated by reference in its entirety.

BACKGROUND

The following disclosure relates to a sheet conveyor configured to convey a sheet along a conveyance path and to an image recording apparatus including the sheet conveyor and configured to record an image on the sheet conveyed by the sheet conveyor.

There are known sheet conveyors having a conveyance path through which a sheet is conveyed. The sheet conveyor is provided in image recording apparatuses such as a printer and a multi-function peripheral (MFP). The image recording apparatus including the sheet conveyor records an image on the sheet conveyed on the conveyance path by the sheet conveyor.

Some sheet conveyors having the conveyance path therein have an opening formed in a housing for partly exposing the conveyance path, and this opening is opened and closed by a cover. The cover is supported pivotably with respect to the housing. For example, the cover closes the opening when located at a standing position, and exposes the opening when located at a lying position. When the cover is located at the lying position, the sheet jammed in the conveyance path can be removed through the exposed opening, for example.

There is known a construction for limiting movement of a cover pivotable with respect to a housing. In this construction, the cover can be opened upward with respect to the housing, and the housing is provided with a stopper that prevents the cover from being opened beyond a predetermined range.

SUMMARY

In the case where the above-described stopper is employed for a construction in which a cover is pivoted by gravity from a standing position to a lying position, the stopper limits movement of the cover pivoted from the standing position to the lying position. In this case, however, collision of the cover with the stopper may cause a large noise, which may surprise a user. Also, impact due to the collision of the cover with the stopper may cause breakage in the cover. On the other hand, the user can more easily perform an operation of, e.g., removing a jammed sheet through the opening in the case where the cover is opened by a large amount with respect to the opening, that is, in the case where the cover is pivoted at large angles, for example.

Accordingly, an aspect of the disclosure relates to (i) a sheet conveyor capable of reducing a large noise due to impact when a cover is pivoted from a standing position to a lying position and capable of reducing breakage of the cover and (ii) an image recording apparatus including the conveyor.

In one aspect of the disclosure, a sheet conveyor includes: a housing defining therein a conveyance path along which a sheet is to be conveyed, the housing having a first side surface that has an opening; a cover pivotable about a pivot axis between (i) a standing position at which the cover closes the opening and (ii) a lying position at which the cover exposes a portion of the conveying path through the opening; a shaft defining the pivot axis, the shaft being provided at one of the housing and the cover, and the other of the housing and the cover having an elongated hole through which the shaft is inserted; and a limiter provided at the housing and having a contact surface configured to contact the cover when the cover pivots from the standing position to the lying position. The contact surface has a first end and a second end that is closer to the conveyance path than the first end, and the contact surface is inclined with respect to a horizontal direction such that the first end is located below the second end. In a state in which the cover is in contact with the contact surface, relative movement between the elongated hole and the shaft in the elongated hole permits the cover to move in such a direction that a pivoting distal end of the cover moves away from the opening.

In another aspect of the disclosure, a sheet conveyor includes: a housing defining therein a conveyance path along which a sheet is to be conveyed, the housing including a shaft and a side surface that has an opening; a cover having an elongated hole through which the shaft of the housing is inserted, the cover being pivotable about the shaft between a standing position and a first lying position and movable from the first lying position to a second lying position, the cover being configured to, when at the standing position, close the opening and configured to, when at the first lying position, expose a portion of the conveying path through the opening; and a limiter disposed at the housing and having a contact surface configured to contact the cover when the cover pivots from the standing position to the first lying position. The contact surface is inclined with respect to a horizontal direction such that one end thereof farther from the opening is lower than the other end thereof closer to the opening. The cover is configured to, in response to contact of the contact surface with the cover, slide on the contact surface from the first lying position to the second lying position in a direction away from the opening, and the shaft is positioned at a first end of the elongated hole when the cover is located at the first lying position and positioned at a second end of the elongated hole when the cover is located at the second lying position, the first end being closer to a pivoting distal end of the cover than the second end.

In another aspect of the disclosure, an image recording apparatus includes: a sheet conveyor including (a) a housing defining therein a conveyance path along which a sheet is to be conveyed, the housing having a first side surface that has an opening, (b) a cover pivotable about a pivot axis between (i) a standing position at which the cover closes the opening and (ii) a lying position at which the cover exposes a portion of the conveying path through the opening, (c) a shaft defining the pivot axis, the shaft being provided at one of the housing and the cover, and the other of the housing and the cover having an elongated hole through which the shaft is inserted, and (d) a limiter provided at the housing and having a contact surface configured to contact the cover when the cover pivots from the standing position to the lying position; and an image recorder configured to record an image on the sheet conveyed along the conveyance path in the housing. The contact surface has a first end and a second end that is closer to the conveyance path than the first end, and the contact surface is inclined with respect to a horizontal direction such that the first end is located below the second end. In a state in which the cover is in contact with the contact surface, relative movement between the elongated hole and the shaft in the elongated hole permits the cover to move in such a direction that a pivoting distal end of the cover moves away from the opening.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENTS

Hereinafter, there will be described one embodiment by reference to the drawings. It is to be understood that the following embodiment is described only by way of example, and the disclosure may be otherwise embodied with various modifications without departing from the scope and spirit of the disclosure.

Overall Construction of MFP

Figure 1:
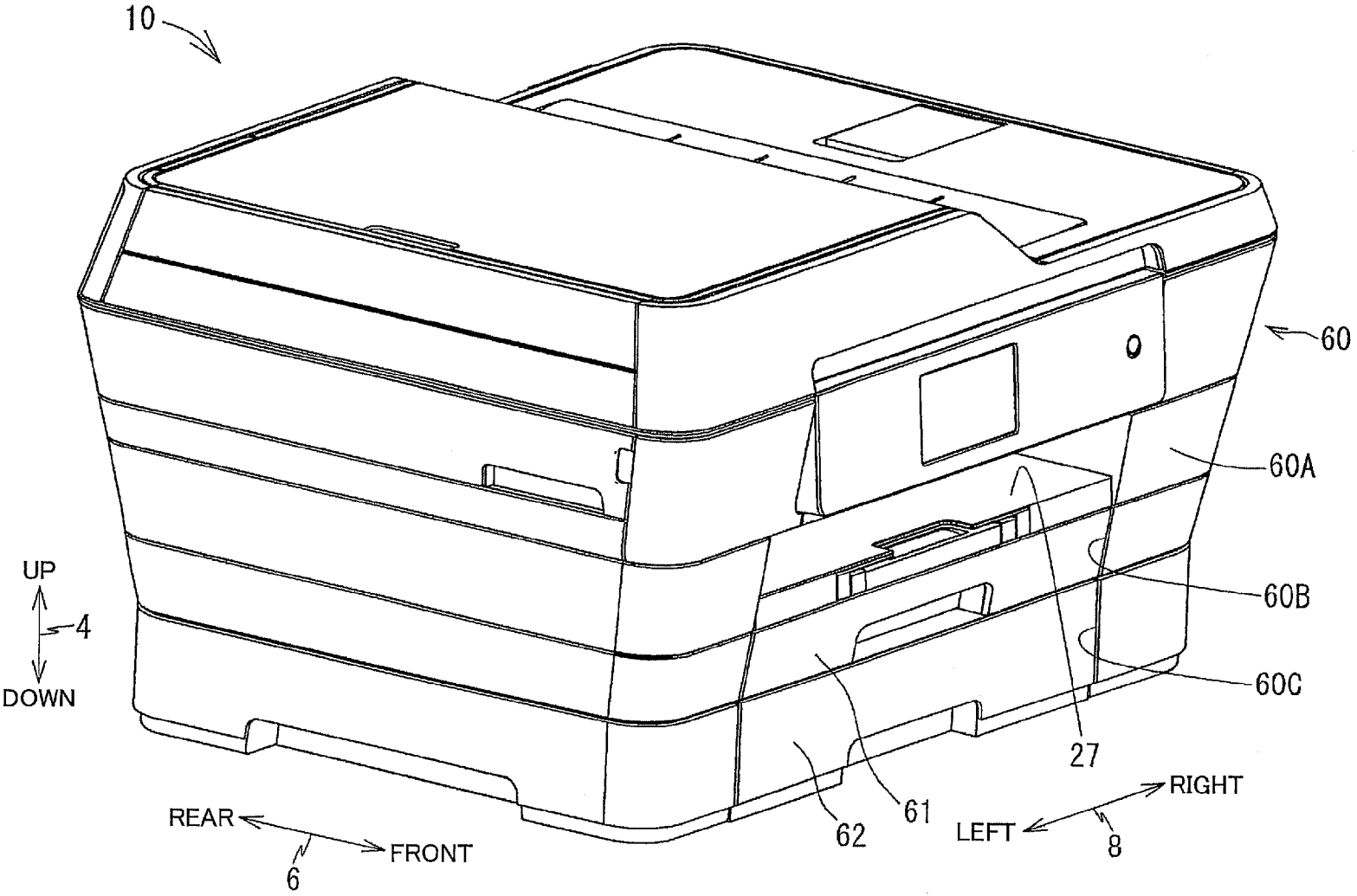
FIG. 1 is a perspective view of a multi-function peripheral (NFP)

FIG. 1 illustrates a multi-function peripheral (MFP) 10 as one example of an image recording apparatus. The MFP 10 includes a sheet conveyor and has various functions such as a printing function, a facsimile function, and a copying function. The printing function is for recording an image on a recording sheet 12 (see FIG. 4) as one example of a sheet.

The MFP 10 is used in a state illustrated in FIG. 1. In the following description, an up and down direction 4, a front and rear direction 6, and a right and left direction 8 of the MFP 10 are defined as illustrated in FIG. 1. The up and down direction 4 corresponds to an up and down direction in which gravity acts. The right and left direction 8 may be hereinafter referred to as "widthwise direction 8" in the following description.

As illustrated in FIG. 1, the MFP 10 includes a housing 60 having a generally rectangular parallelepiped shape. The housing 60 defines an outer shape of the MFP 10. A first supply tray 61 and a second supply tray 62 are provided in the housing 60. The first supply tray 61 is disposed over the second supply tray 62.

A front surface 60A of the housing 60 has a first opening 60B. The first supply tray 61 provided in the housing 60 can be drawn frontward through the first opening 60B. The front surface 60A of the housing 60 also has a second opening 60C under the first opening 60B. The second supply tray 62 provided in the housing 60 can be drawn frontward through the second opening 60C.

Figure 2B:
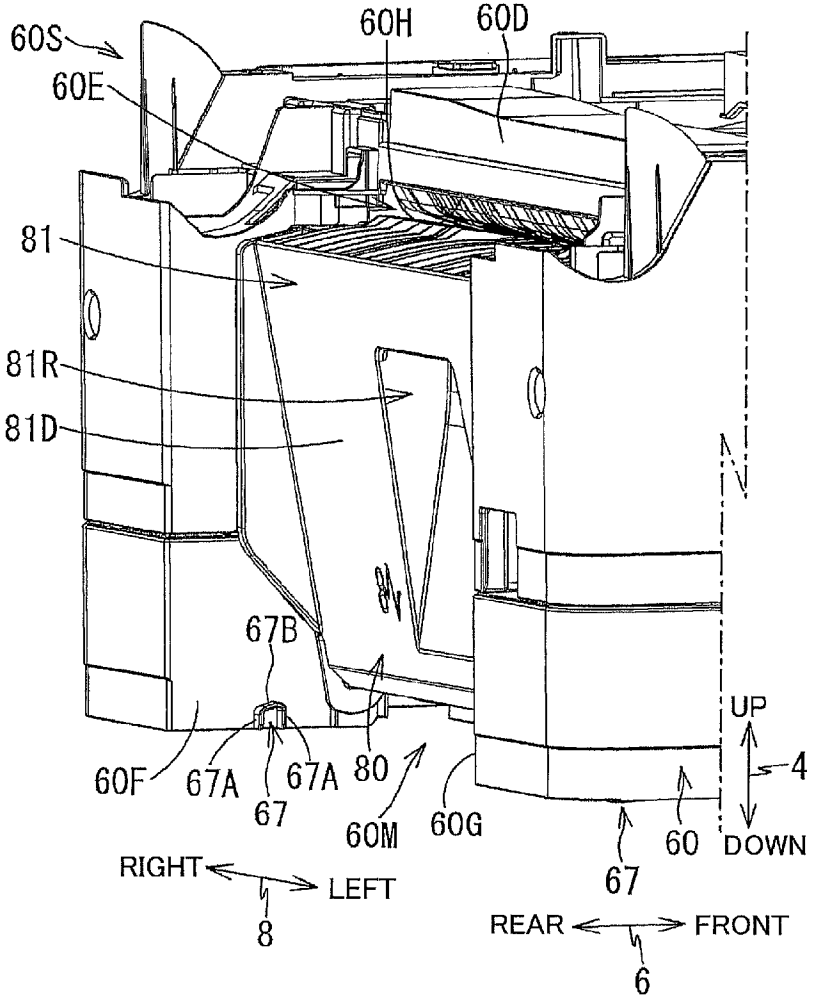
FIG. 2B is a perspective view of the rear end portion of the housing in a state in which the cover is slightly pivoted from a standing position to a lying position.
Figure 2A:
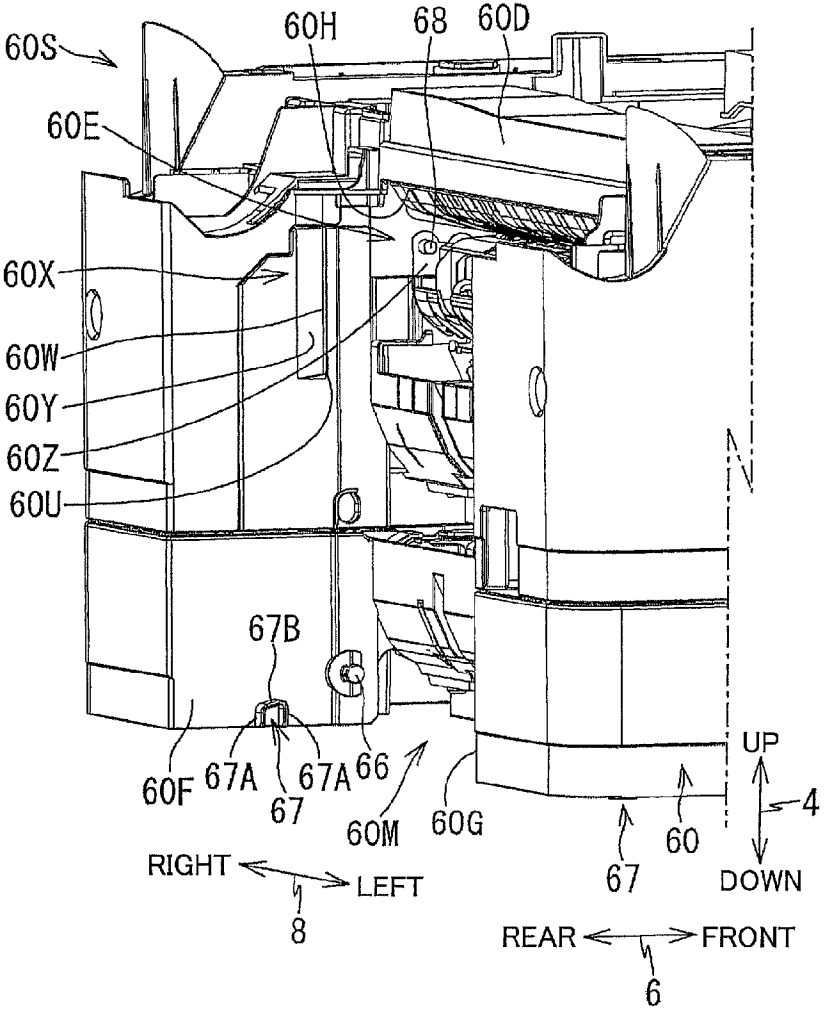
FIG. 2A is a perspective view of a rear end portion of a housing of the NFP, with a cover removed.

As illustrated in FIG. 2A, a recess 60M is formed in a central portion of a rear end portion 60S of the housing 60 in the widthwise direction 8. While a cover 80 is disposed in the recess 60M as illustrated in FIG. 2B, FIG. 2A omits illustration of the cover 80. The cover 80 normally extends in the up and down direction 4. In FIG. 2B, the cover 80 is slightly pivoted rearward.

The recess 60M is formed in a central portion of the housing 60 in the widthwise direction 8 so as to be recessed frontward from a rear surface of the housing 60. The recess 60M extends in the up and down direction 4. Upper, lower, and rear sides of the recess 60M are not defined. A first side surface 60D and the cover 80 are provided in front of the recess 60M. The first side surface 60D defines a front end of the recess 60M. The housing 60 has: a second side surface 60F defining a right end of the recess 60M; and a third side surface 60G defining a left end of the recess 60M. Each of the second side surface 60F and the third side surface 60G is a flat surface extending in the front and rear direction 6 and the up and down direction 4. The second side surface 60F and the third side surface 60G are spaced apart from and opposed to each other in the widthwise direction 8.

The first side surface 60D is located between upper portions of the second side surface 60F and the third side surface 60G so as to extend in the widthwise direction 8. A lower portion of the first side surface 60D has a back opening 60E that is closed by the cover 80 defining a front side of the recess 60M. Right and left edges of the back opening 60E are defined by the second side surface 60F and the third side surface 60G respectively. The upper edge of the back opening 60E is defined by a lower edge 60H of the first side surface 60D. A lower side of the back opening 60E is not defined.

Shafts 66 are respectively provided on bottom portions of the second side surface 60F and the third side surface 60G of the housing 60. Each of the shafts 66 is constituted by a pin which protrudes toward the inside of the recess 60M in the widthwise direction 8. The axes of the respective shafts 66 coincide with the same imaginary line. The shafts 66 support a lower portion of the cover 80 that opens and closes the back opening 60E.

Figure 3:
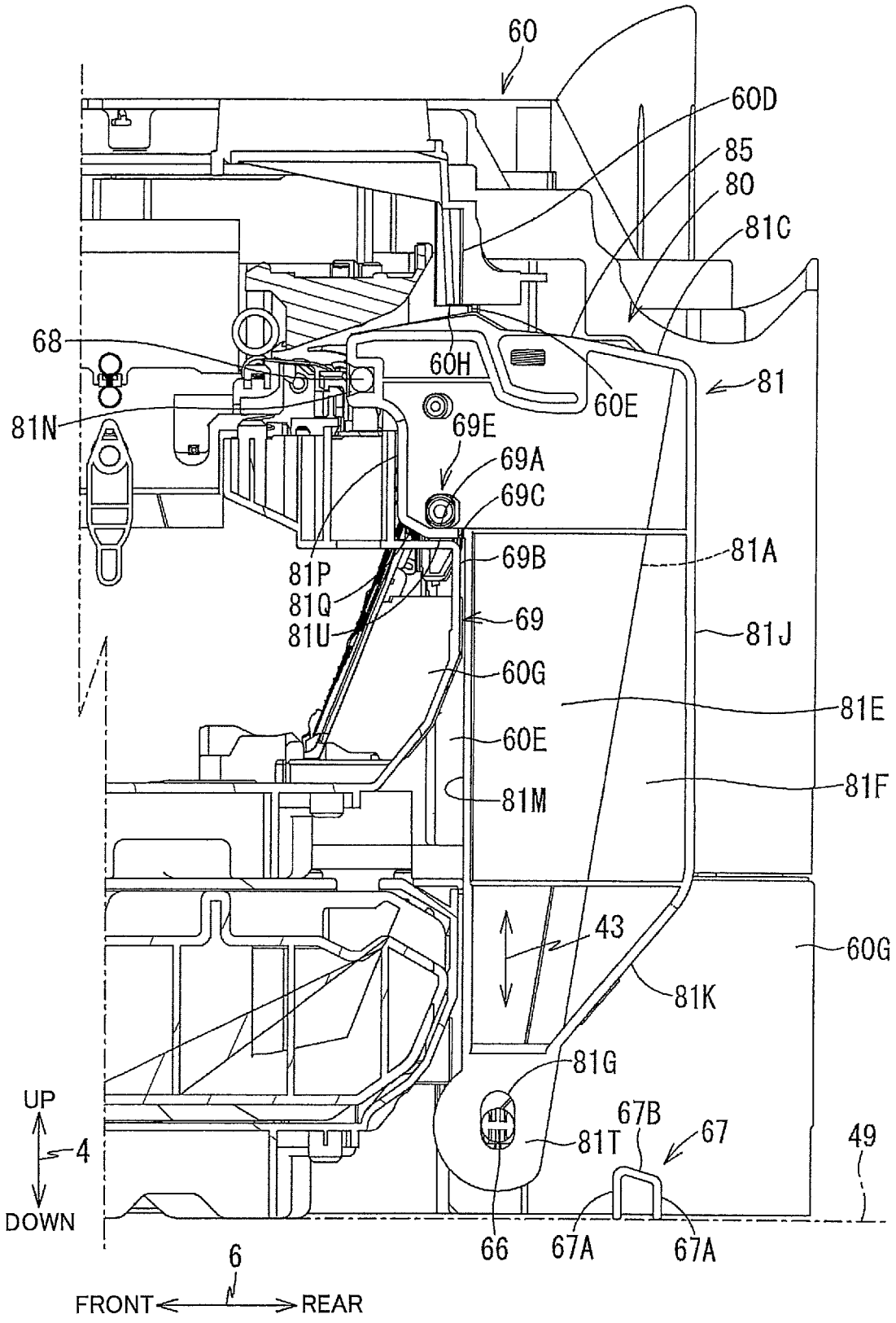
FIG. 3 is an elevational view in vertical cross section illustrating the rear end portion of the housing in a state in which the cover is located at the standing position.

As illustrated in FIG. 3, when the cover 80 is located at a standing position (a closing position), the cover 80 extends in the up and down direction 4 and closes the back opening 60E. When the cover 80 is pivoted about the shafts 66 such that an upper edge of the cover 80 moves rearward and downward, the cover 80 is positioned at a lying position (an open position) (see FIGS. 9 and 10) at which the back opening 60E is open. When the cover 80 is located at the lying position, the inside of the housing 60 is exposed to the outside through the back opening 60E. The construction of the cover 80 will be described later.

As illustrated in FIGS. 2A and 2B, a limiter 67 is provided on a lower end portion of the second side surface 60F at a position spaced apart rearwardly from the shaft 66. The cover 80 is brought into contact with the limiter 67 when the cover 80 is pivoted from the standing position to the lying position. A limiter 67 (see FIG. 3) is also provided on a lower end portion of the third side surface 60G.

The limiter 67 provided on the second side surface 60F is spaced apart reawardly from the shaft 66 provided on the second side surface 60F. The limiter 67 provided on the third side surface 60G is spaced apart rearwardly from the shaft 66 provided on the second side surface 60F. Each of the shafts 66 and a corresponding one of the limiters 67 are located on the same line extending in the front and rear direction 6, as viewed from the top. The limiters 67 have the same construction and are disposed at the same height on the second side surface 60F and the third side surface 60G.

Each of the limiters 67 includes: two legs 67A spaced apart from each other in the front and rear direction 6; and a contact surface 67B provided between upper end portions of the respective legs 67A. Each of the legs 67A is disposed along the up and down direction 4. The contact surface 67B has one end (as one example of a first end) and the other end (as one example of a second end). The one end is farther from the back opening 60E than the other end, and the other end is nearer to the back opening 60E than the one end. The contact surface 67B is inclined with respect to the horizontal direction such that the one end is located below the other end. Lower ends of the legs 67A protrude downward from the housing 60 and are in contact with a placement surface 49 (see FIG. 3) on which the housing 60 is placed.

As illustrated in FIG. 2A, a contact plate 60X extending in the up and down direction 4 is provided on an upper portion of the second side surface 60F. The contact plate 60X extends from a position near an upper edge of the second side surface 60F, to a central portion of the second side surface 60F in the up and down direction 4. The length of the contact plate 60X in the front and rear direction 6 is shorter than that in the up and down direction 4. A surface 60Y of the contact plate 60X which is opposed to the third side surface 60G is inclined with respect to the second side surface 60F such that a front edge of the surface 60Y is nearer to the third side surface 60G than a rear edge of the surface 60Y.

The front edge of the surface 60Y of the contact plate 60X is provided with an inclined surface 60U extending in the up and down direction 4 and inclined so as to be nearer to the second side surface 60F at its front portion than at its rear portion. A protruding portion of the contact plate 60X between the surface 60Y and the inclined surface 60U is an engagement edge 60W extending in the up and down direction 4. The contact plate 60X prevents pivoting of the cover 80 from the standing position to the lying position.

A contact plate 60X (see FIG. 9) similar in construction to the above-described contact plate 60X is also provided on the third side surface 60G.

As illustrated in FIG. 2A, a positioner 68 is provided in the housing 60. The positioner 68 positions the cover 80 to the standing position by being engaged with an engaging portions 81N (see FIG. 3) of the cover 80 which will be described below. The housing 60 has an inner surface 60Z located in front of the second side surface 60F. The positioner 68 is provided on an upper portion of the inner surface 60Z. The positioner 68 is shaped like a circular cylinder and protrudes rightward from the inner surface 60Z of the housing 60 along the widthwise direction 8. The positioner 68 positions the cover 80 to the standing position.

The housing 60 also has an inner surface 60Z (see FIG. 8) located in front of the second side surface 60G. As illustrated in FIG. 3, a positioner 68 similar in construction to the above-described positioner 68 is provided in the housing 60 on an upper portion of the inner surface 60Z (see FIG. 8).

Components for guiding the cover 80 when the cover 80 is pivoted to the standing position are provided in the housing 60. The constructions of these components will be described later with description of the construction of the cover 80.

Figure 4:
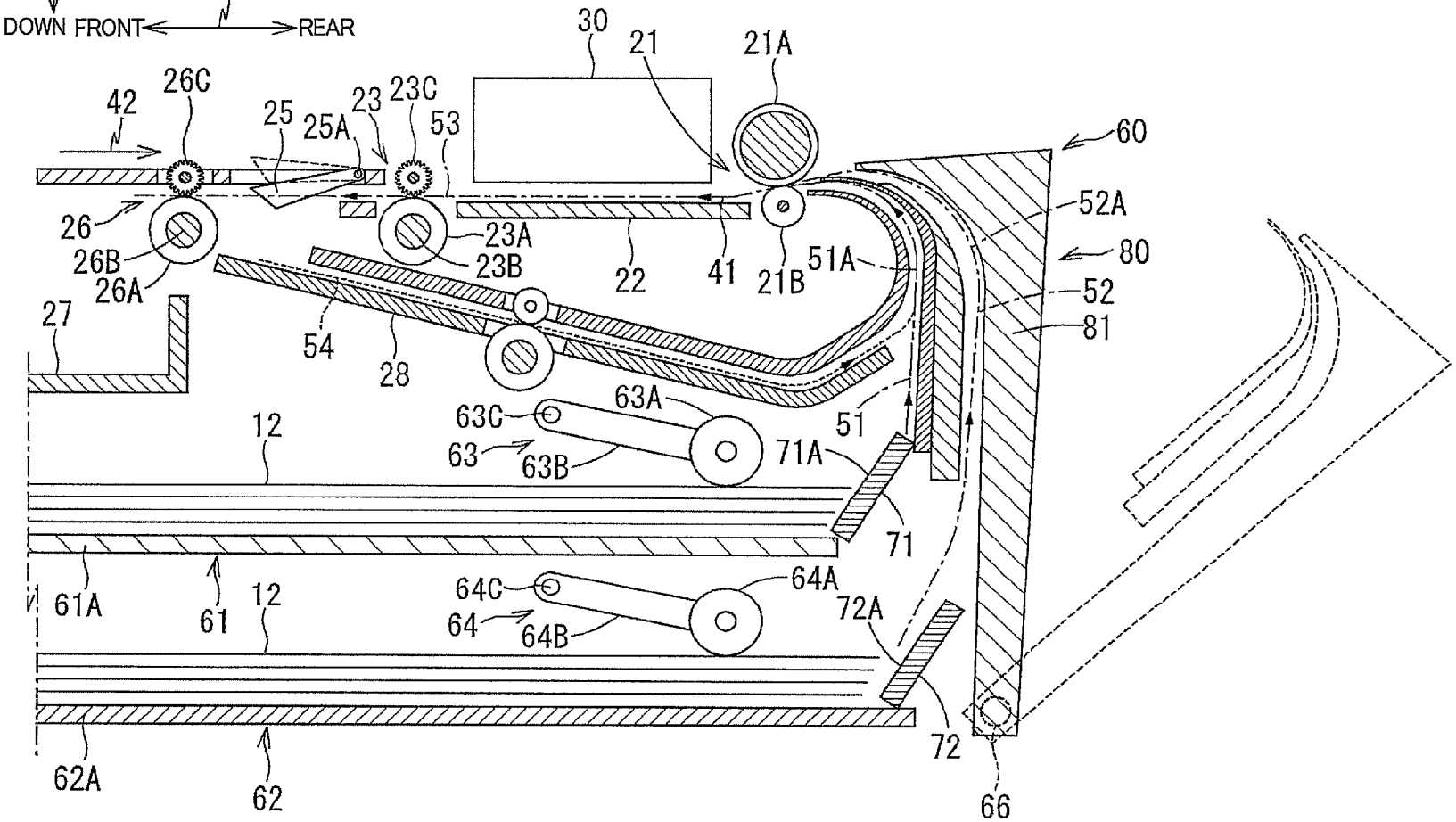
FIG. 4 is a schematic view for explaining a structure in the rear end portion of the housing.

As illustrated in FIG. 4, a plurality of the recording sheets 12 are stored in the first supply tray 61 and the second supply tray 62 provided in the housing 60 in a state in which the recording sheets 12 are stacked on each other in the up and down direction 4. In the first supply tray 61, the recording sheets 12 are supported on a bottom surface 61A of the first supply tray 61. In the second supply tray 62, the recording sheets 12 are supported on a bottom surface 62A of the second supply tray 62.

A first supplier 63 is provided above the first supply tray 61. The first supplier 63 includes a first supply roller 63A disposed on the first supply tray 61 at a position near the cover 80. The first supply roller 63A is rotatably supported by one end portion (a distal end portion) of a first support arm 63B in a state in which the axis of the first supply roller 63A coincides with the widthwise direction 8. The other end portion (a basal end portion) of the first support arm 63B is pivotably supported by a first support shaft 63C that is disposed in parallel with the axis of the first supply roller 63A. The first support arm 63B extends rearward and downward from the first support shaft 63C.

When the first support arm 63B is pivoted about the first support shaft 63C so as to move the distal end portion of the first support arm 63B downward in a state in which the first supply roller 63A is located above the recording sheet 12, the first supply roller 63A is brought into contact with an uppermost one of the recording sheets 12 placed on the first supply tray 61. When the first supply roller 63A is rotated in this state, the uppermost sheet 12 contacting the first supply roller 63A is supplied rearward. In the present embodiment, the recording sheet 12 supplied from the first supply tray 61 is conveyed in a state in which a central position of the recording sheet 12 in the widthwise direction 8 is located on a center line CL (schematically indicated in FIG. 5) of a first conveyance path 51, which will be described below, in the widthwise direction 8. This kind of conveyance of the recording sheet 12 is called conveyance with center alignment.

A first guide 71 is provided at a rear of the first supply tray 61. The first guide 71 has a first guide surface 71A facing frontward. The first guide surface 71A is inclined such that its rear end is located above its front end. The recording sheet 12 supplied by the first supplier 63 is guided rearward and upward by the first guide surface 71A.

A second supplier 64 is provided above the second supply tray 62. The second supplier 64 is similar in construction to the first supplier 63 except for the second supplier 64 being disposed above the second supply tray 62. That is, the second supplier 64 includes a second supply roller 64A and a second support arm 64B, and the second support arm 64B is pivotably supported by a second support shaft 64C. The second support arm 64B extends rearward and downward from the second support shaft 64C.

The first conveyance path 51 is defined above the first guide 71, and the recording sheet 12 guided by the first guide 71 is conveyed through this first conveyance path 51. The first conveyance path 51 extends upward from an upper end of the first guide 71 and curved so as to extend frontward. The curved portion in the upper portion of the first conveyance path 51 will be referred to as "first curved path 51A". The recording sheet 12 guided by the first guide 71 is conveyed upward in a lower portion of the first conveyance path 51 and then conveyed frontward in the first curved path 51A.

A second guide 72 is provided at a rear of the second supply tray 62. The second guide 72 has a second guide surface 72A facing frontward. The second guide surface 72A is inclined such that its rear end is located above its front end. The recording sheet 12 supplied by the second supplier 64 is guided rearward and upward by the second guide surface 72A.

A second conveyance path 52 is defined above a rear end portion of the second supply tray 62, and the recording sheet 12 supplied by the second supplier 64 is conveyed through the second conveyance path 52. The second conveyance path 52 is located at a rear of the first conveyance path 51, that is, the second conveyance path 52 is located on an outer side of the curved portion of the first conveyance path 51. An upper end portion of the second conveyance path 52 is a second curved path 52A which is curved so as to extend frontward. A downstream end of the second curved path 52A in a direction in which the recording sheet 12 is conveyed (hereinafter referred to as "conveying direction") is connected to the first conveyance path 51 at a position located downstream of the first curved path 51A of the first conveyance path 51 in the conveying direction. The recording sheet 12 guided by the second guide 72 is conveyed upward in a lower portion of the second conveyance path 52, then conveyed frontward in the second curved path 52A, and finally guided to the first conveyance path 51.

A component partly defining the first conveyance path 51 and the second conveyance path 52 is mounted on the cover 80. When the cover 80 is located at the lying position, the first conveyance path 51 is exposed to the outside via the back opening 60E. As described above, the contact surface 67B of the limiter 67 is inclined with respect to the horizontal direction such that the one end farther from the back opening 60E than the other end is located below the other end nearer to the back opening 60E than the one end. That is, the contact surface 67B of the limiter 67 is inclined with respect to the horizontal direction such that the one end farther from the first conveyance path 51 than the other end is located below the other end nearer to the first conveyance path 51 than the one end.

Downstream ends of the first conveyance path 51 and the second conveyance path 52 continue to an upper conveyance path 53 extending in the front and rear direction 6 in the housing 60. The recording sheet 12 conveyed through the first conveyance path 51 or the second conveyance path 52 is conveyed frontward in the upper conveyance path 53.

On the upper conveyance path 53, a first conveying roller device 21, a platen 22 and an image recorder 30, a second conveying roller device 23, a flap 25, a switch-back roller device 26, and a discharge tray 27 are disposed in order from an upstream side in a conveying direction 41.

The first conveying roller device 21 conveys the recording sheet 12 frontward and includes: a first conveying roller 21A disposed with its axis extending in the widthwise direction 8; and a plurality of pinch rollers 21B disposed under the first conveying roller 21A.

The first conveying roller 21A is contactable with an upper surface of the recording sheet 12 conveyed through the first conveyance path 51 or the second conveyance path 52. It is noted that the upper surface of the recording sheet 12 may be hereinafter referred to as "first surface". The first conveying roller 21A extends over the entire length of the upper conveyance path 53 in the widthwise direction 8. The pinch rollers 21B are spaced apart from each other in the widthwise direction 8 at a specific distance. Each of the pinch rollers 21B is in contact with the first conveying roller 21A. When the first conveying roller 21A is rotated, the pinch rollers 21B contacting the first conveying roller 21A are rotated by the rotation of the first conveying roller 21A.

The platen 22 extends in the front and rear direction 6 and in the widthwise direction 8. An upper surface of the platen 22 supports the recording sheet 12 conveyed by the first conveying roller device 21. The image recorder 30 is provided over the platen 22. The image recorder 30 is an ink-jet recording device which records an image on the recording sheet 12 supported on the platen 22. During image recording, rotation of the first conveying roller device 21 is stopped, so that the recording sheet 12 is stopped on the platen 22. In this state, the image recorder 30 selectively ejects ink onto the recording sheet 12, whereby an image corresponding to one line is recorded on the recording sheet 12. Upon completion of this recording, the first conveying roller device 21 is rotated again. When the recording sheet 12 has been conveyed to the next line in the conveying direction 41, the first conveying roller device 21 is stopped to stop the recording sheet 12. In this state, the image recorder 30 is located upstream of the line on which the preceding image recording is performed, in the conveying direction 41. These operations are repeated to perform image recording on the entire recording sheet 12.

The second conveying roller device 23 conveys the recording sheet 12 supported on the platen 22 frontward. The second conveying roller device 23 is located in front of the platen 22. The second conveying roller device 23 includes: a second roller shaft 23B disposed with its axis extending in the widthwise direction 8; a plurality of second conveying rollers 23A attached to the second roller shaft 23B; and a plurality of first spur rollers 23C disposed over the respective second conveying rollers 23A.

When the second roller shaft 23B is rotated, the second conveying rollers 23A are rotated together with the second roller shaft 23B. The first spur rollers 23C are rotated by the rotations of the respective second conveying rollers 23A. When the recording sheet 12 supported on the platen 22 is conveyed to a position between the second conveying rollers 23A and the first spur rollers 23C which are being rotated, the recording sheet 12 is nipped between the second conveying rollers 23A and the first spur rollers 23C and conveyed frontward.

The switch-back roller device 26 is disposed in front of the second conveying roller device 23. The switch-back roller device 26 includes: a third roller shaft 26B disposed with its axis extending in the widthwise direction 8; a plurality of switch-back rollers 26A attached to the third roller shaft 26B so as to be arranged in the widthwise direction 8; and a plurality of second spur rollers 26C disposed over the respective switch-back rollers 26A.

The switch-back roller device 26 switches a state of the upper conveyance path 53 between a state in which the recording sheet 12 conveyed frontward is conveyed further frontward and a state in which the recording sheet 12 conveyed frontward is conveyed rearward. The third roller shaft 26B is rotatable forwardly and reversely. When the switch-back rollers 26A are rotated forwardly or reversely together with the third roller shaft 26B, the second spur rollers 26C are rotated by the rotations of the respective switch-back rollers 26A.

A third conveyance path 54 is connected to the upper conveyance path 53 at a position between the second conveying roller device 23 and the switch-back roller device 26. The third conveyance path 54 is for conveying the recording sheet 12 with the image recorded on the first surface, to the first conveyance path 51 again.

The third conveyance path 54 is defined by a conveyance guide 28 that extends rearward from a position located at a rear of the switch-back roller device 26, to a portion of the first conveyance path 51 which is located upstream of the image recorder 30 in the conveying direction 41. An upper surface of the conveyance guide 28 as a guide surface is inclined so as to be lower at its portion far from the switch-back roller device 26 than at its portion near the switch-back roller device 26. The conveyance guide 28 is located below the platen 22.

The flap 25 is disposed on the upper conveyance path 53 at a position between the second conveying roller device 23 and the switch-back roller device 26. The flap 25 is located on an upper portion of the upper conveyance path 53. The flap 25 extends frontward from a pivot shaft 25A and pivotable about the pivot shaft 25A. When a free end portion of the flap 25 is located in the upper conveyance path 53, the flap 25 contacts a leading end of the recording sheet 12 conveyed on the upper conveyance path 53 in the conveying direction 41. In this contact, the recording sheet 12 causes pivotal movement of the flap 25 so as to move the free end portion upward. As a result, the recording sheet 12 is conveyed under the flap 25 in the conveying direction 41 and reaches the switch-back roller device 26. When the recording sheet 12 is to be conveyed by the switch-back roller device 26 in a direction 42 reverse to the conveying direction 41, the recording sheet 12 is brought into contact with the free end portion of the flap 25 which is located in the upper conveyance path 53. The recording sheet 12 is guided to the third conveyance path 54 by a lower surface of the free end portion of the flap 25.

The housing 60 is provided with the discharge tray 27 extending frontward from a position under a downstream end of the upper conveyance path 53. The discharge tray 27 is located above the first supply tray 61. Here, a surface of the recording sheet 12 which is a back side of the recording sheet 12 from the first surface is defined as a second surface. The recording sheet 12 with an image recorded on the first surface or each of the first surface and the second surface is conveyed through the switch-back roller device 26 in the conveying direction 41 and discharged onto the discharge tray 27. The discharge tray 27 is capable of supporting a plurality of the recording sheets 12 stacked on each other.

Cover 80

Figure 7:
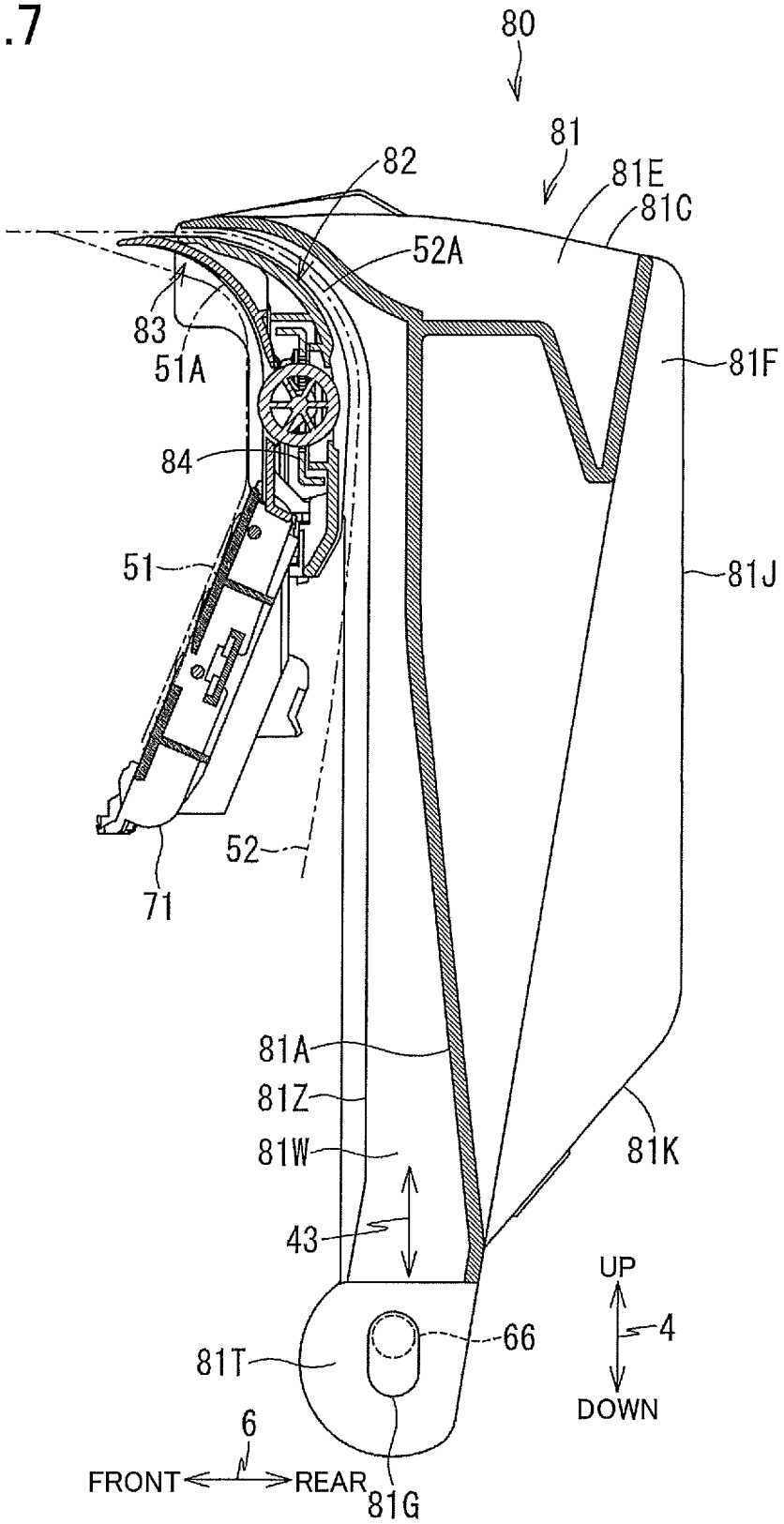
FIG. 7 is an elevational view in vertical cross section illustrating the cover located at the standing position.

As illustrated in FIG. 2B, the cover 80 has a cover body 81 that covers the back opening 60E formed in the first side surface 60D. As illustrated in FIG. 7, a first resin member 82 and a second resin member 83 are mounted on the cover body 81 to define the first conveyance path 51 and the second conveyance path 52. A metal frame 84 is provided between the first resin member 82 and the second resin member 83.

The following explanation for components of the cover 80 is provided assuming that the cover 80 is located at the standing position for closing the back opening 60E (i.e., the state illustrated in FIG. 3), unless otherwise specified. That is, the up and down direction 4, the front and rear direction 6, and the right and left direction 8 defined as described above are used for the following explanation for the components of the cover 80.

Cover Body 81

Figure 5:
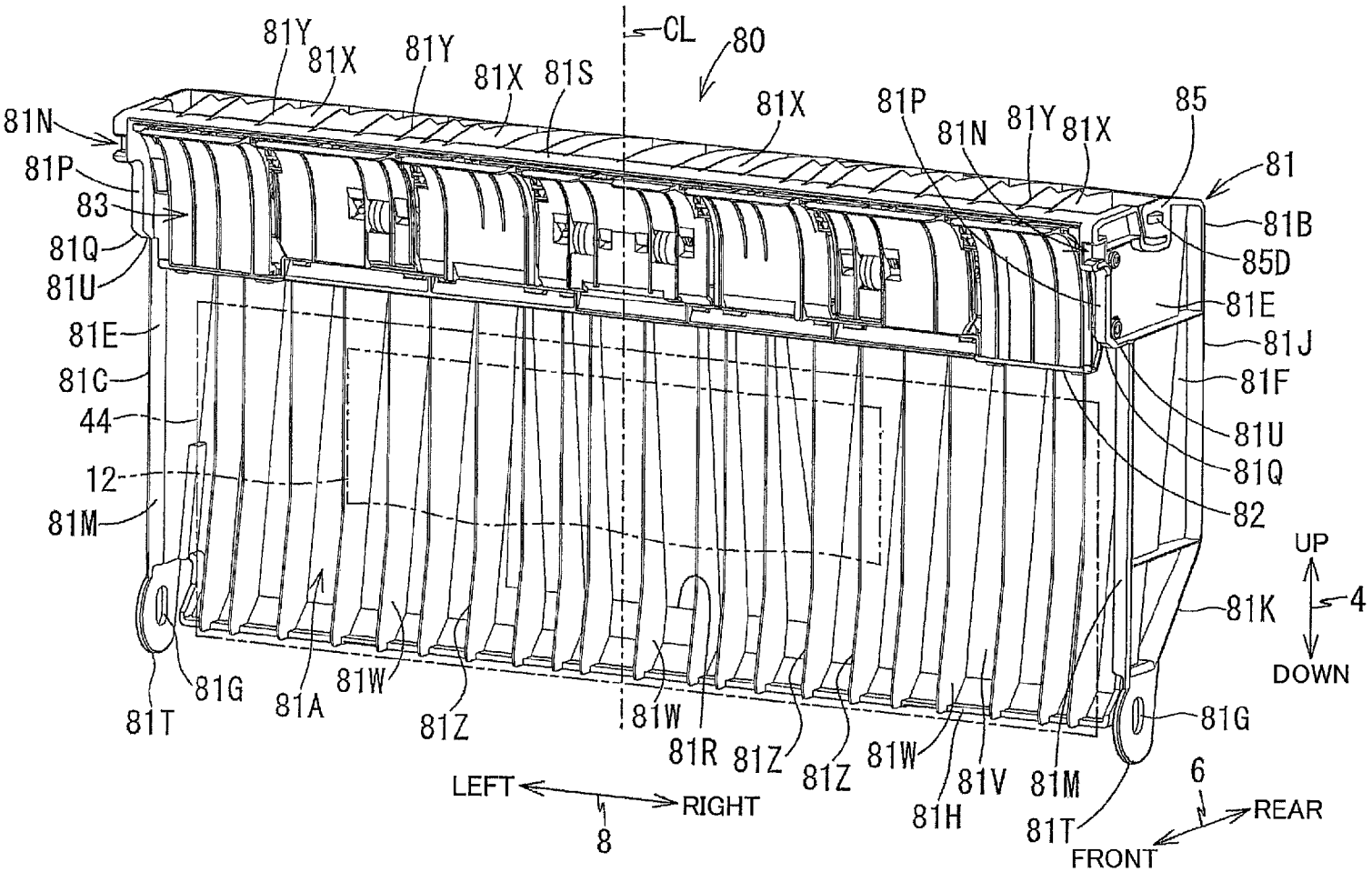
FIG. 5 is a perspective view of the cover located at the standing position, with the cover viewed from a front side thereof.
Figure 6:
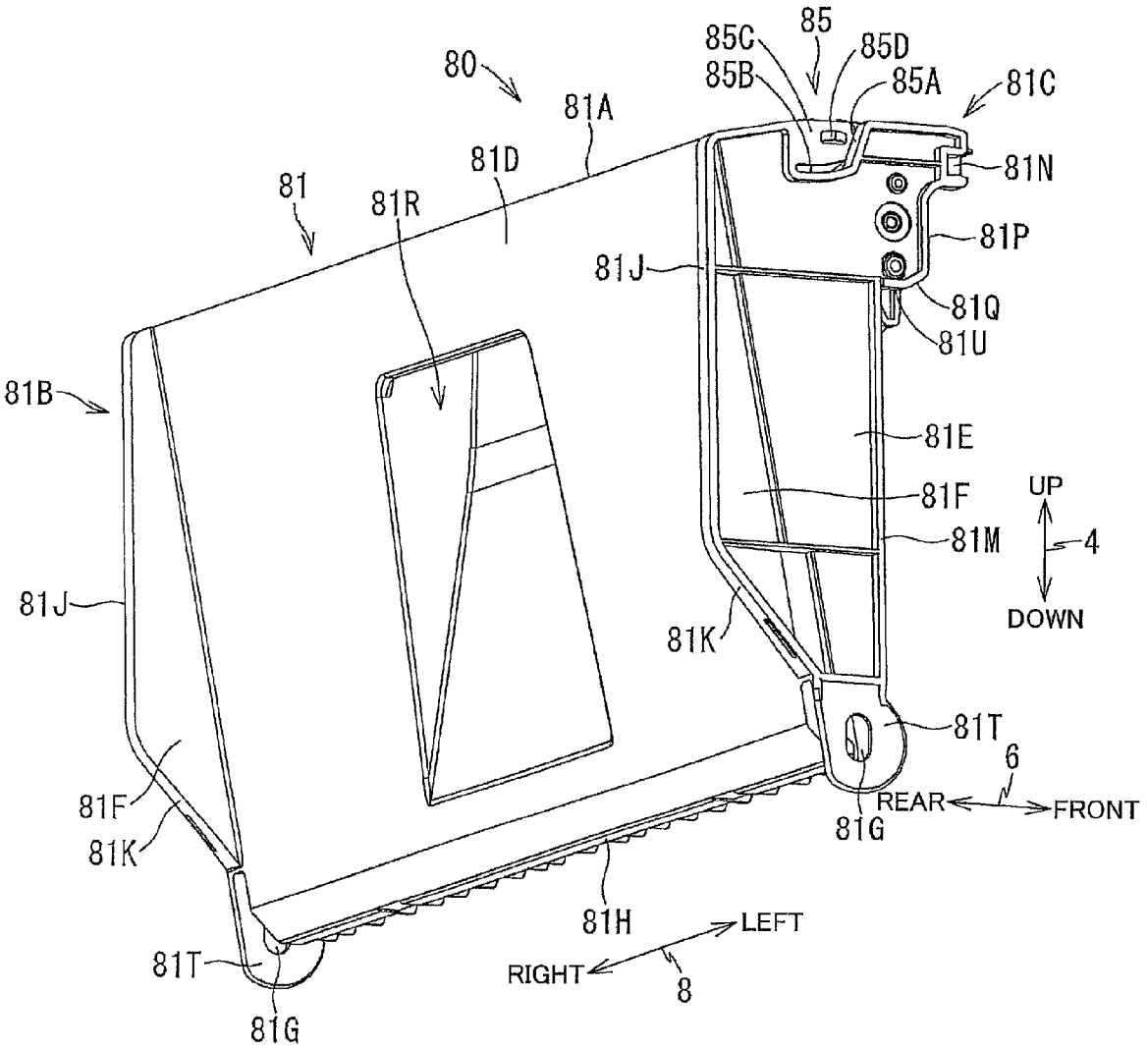
FIG. 6 is a perspective view of the cover located at the standing position, with the cover viewed from a rear side thereof.

As illustrated in FIGS. 5 and 6, the cover 80 includes: a base 81A generally shaped like a plate; and a first side portion 81B and a second side portion 81C respectively provided on a right end and a left end of the base 81A. The base 81A is shaped like a rectangular planar plate with a size allowing the base 81A to close the back opening 60E. The base 81A has a back surface 81D (see FIG. 6) as one example of a housing outer surface which constitutes an outer surface of the housing 60. As illustrated in FIG. 6, a bottom surface 81H protruding frontward is provided on a lower end portion of the base 81A.

An operation recess 81R is formed in a central portion of the base 81A in the widthwise direction 8 and the up and down direction 4. An operator inserts his or her hand into the operation recess 81R to open or close the cover 80.

Each of the first side portion 81B and the second side portion 81C is shaped like a plate and has a generally rectangular shape except its lower portion. The first side portion 81B and the second side portion 81C are disposed respectively along the second side surface 60F and the third side surface 60G of the housing 60 which define the recess 60M. A lower portion of each of the first side portion 81B and the second side portion 81C is shaped such that its length in the front and rear direction 6 decreases with decreasing height. A protruding portion 81T protruding downward is provided on the lowermost portion of each of the first side portion 81B and the second side portion 81C. The protruding portion 81T has an elongated hole 81G.

Each of the first side portion 81B and the second side portion 81C includes: a side-portion body 81E located in front of a corresponding one of opposite ends of the base 81A in the widthwise direction 8 in the state in which the cover 80 is located at the standing position; and a protrusion 81F located at a rear of the corresponding end of the base 81A in the widthwise direction 8 in the state in which the cover 80 is located at the standing position. As illustrated in FIG. 6, when the cover 80 is located at the standing position, the base 81A is inclined such that its upper end is located further to the rear than its lower end.

Each of the side-portion bodies 81E has an upper front end surfaces 81P and a lower front end surfaces 81M located respectively on an upper portion and a lower portion of a front end of the side-portion body 81E in the state in which the cover 80 is located at the standing position. When the cover 80 is located at the standing position, the upper front end surface 81P and the lower front end surface 81M extend in the up and down direction 4, and the upper front end surface 81P is located further toward the front than the lower front end surface 81M. Each of the upper front end surface 81P and the lower front end surface 81M has a length in the widthwise direction 8 which is constant in the up and down direction 4.

As illustrated in FIGS. 5 and 6, the engaging portion 81N is provided on an upper portion of the upper front end surface 81P. The engaging portion 81N is recessed rearward from the upper front end surface 81P so as to form an opening.

A first guide surface 81Q continues to a lower portion of the upper front end surface 81P. The first guide surface 81Q has the same length as the upper front end surface 81P in the widthwise direction 8. The first guide surface 81Q is inclined downward and rearward with respect to the upper front end surface 81P. The length of the first guide surface 81Q in a direction of its inclination is shorter than that of the upper front end surface 81P in the up and down direction 4.

A sliding contact surface 81U facing downward continues to a lower end of the first guide surface 81Q. The sliding contact surface 81U extends rearward from the lower end of the first guide surface 81Q. The lower front end surface 81M continues to a rear end of the sliding contact surface 81U. A front edge of the protruding portion 81T continues to a lower end of the lower front end surface 81M.

Figure 9:
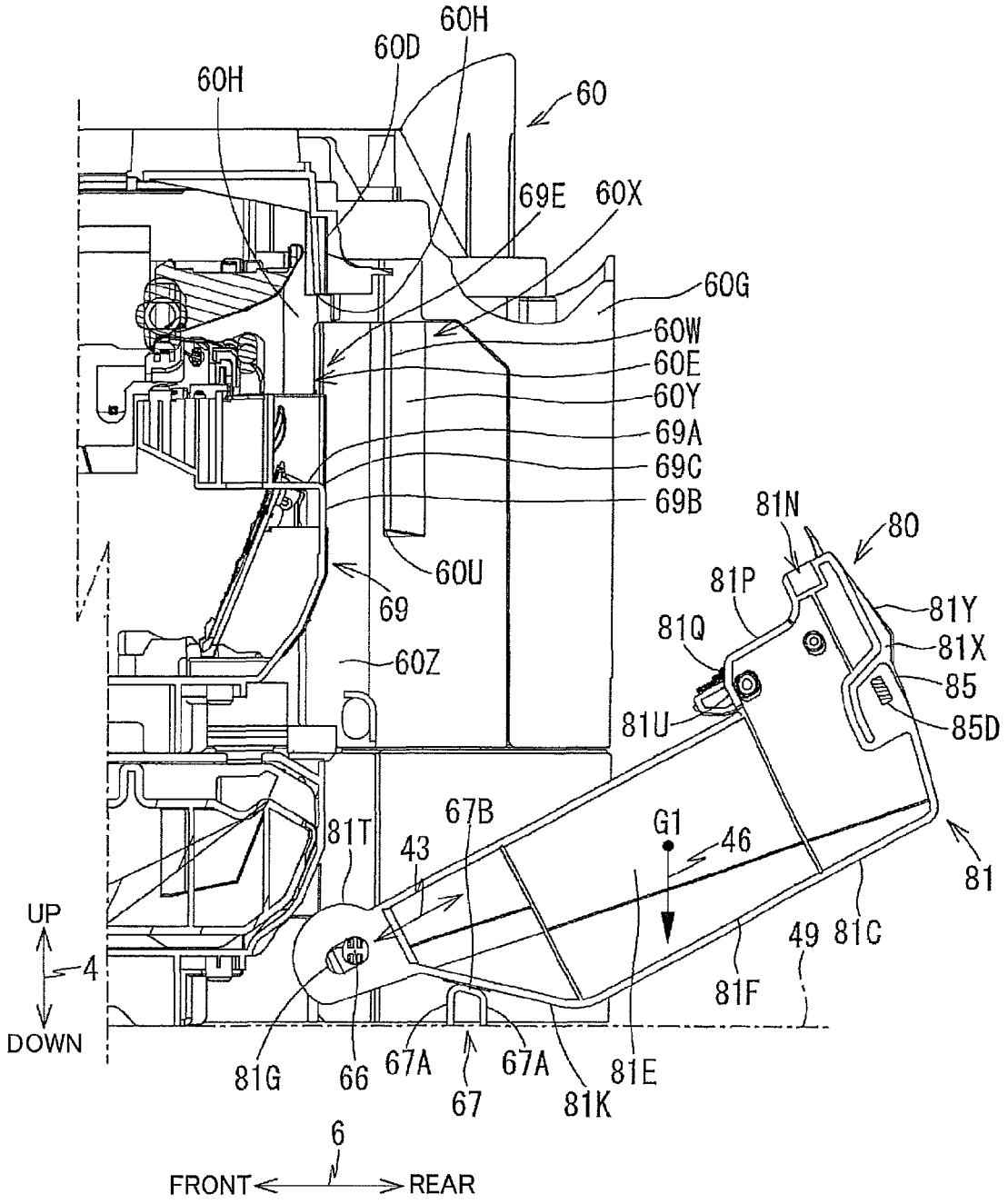
FIG. 9 is an elevational view in vertical cross section illustrating the rear end portion of the housing in a state in which the cover is pivoted from the standing position to the lying position.

As illustrated in FIGS. 3 and 9, supporters 69E are respectively provided on the inner surfaces 60Z respectively continuous frontward from the second side surface 60F and the third side surface 60G defining the recess 60M of the housing 60. Each of the supporters 69E is a portion of a frame 69 disposed along the widthwise direction 8. The frame 69 includes: a rear surface 69B opposed to the back opening 60E; and support surfaces 69A continuous frontwardly from an upper end of the rear surface 69B.

The rear surface 69B is shaped like a plate extending in the widthwise direction 8 and the up and down direction 4. Each of the support surfaces 69A is also shaped like a plate extending in the widthwise direction 8 and the front and rear direction 6 and facing upward. Bent portions 69C are provided each between the rear surface 69B and a corresponding one of the support surfaces 69A.

Each of the supporters 69E is formed by: a corresponding one of the support surfaces 69A respectively provided on opposite ends of the frame 69 in the widthwise direction 8; the rear surface 69B; and a corresponding one of the bent portions 69C.

The protruding portion 81T of the lowermost portion of each of the side-portion bodies 81E has the elongated hole 81G that is formed through the protruding portion 81T in the widthwise direction 8. The elongated hole 81G is elongated in one direction (hereinafter referred to as "longitudinal direction 43") that is directed from the shaft 66 toward the pivoting distal end of the cover 80. When the cover 80 is located at the standing position, the longitudinal direction 43 of the elongated hole 81G coincides with the up and down direction 4.

The shafts 66 provided respectively on the second side surface 60F and the third side surface 60G of the housing 60 are inserted in the respective elongated holes 81G (see FIG. 3). Each of the first side portion 81B and the second side portion 81C having the respective elongated holes 81G is pivotable about a corresponding one of the shafts 66. The shafts 66 are slidable along the respective elongated holes 81G in the longitudinal direction 43.

As illustrated in FIG. 6, each of the respective protrusions 81F of the first side portion 81B and the second side portion 81C is generally shaped like a triangle. An upper portion of a rear edge portion of each of the protrusions 81F has a first inclined surface 81J inclined with respect to the base 81A. A lower portion of the rear edge portion of the protrusion 81F has a second inclined surface 81K inclined with respect to the base 81A. The first inclined surface 81J is inclined so as to extend downward from the base 81A, and the second inclined surface 81K in inclined so as to extend upward from the base 81A. The first inclined surface 81J is inclined with respect to the base 81A such that the length of the first inclined surface 81J from the base 81A in the rear direction is longer at a lower end of the first inclined surface 81J than at its upper end. The second inclined surface 81K is inclined with respect to the base 81A such that the length of the second inclined surface 81K from the base 81A in the rear direction is shorter at a lower end of the second inclined surface 81K than at its upper end.

When the cover 80 is located at the lying position, the second inclined surfaces 81K of the respective protrusions 81F are in contact with the respective contact surfaces 67B of the limiters 67 provided in the housing 60. The angle of inclination of each of the contact surfaces 67B is set such that the contact surface 67B is parallel with the second inclined surface 81K in a state in which the contact surface 67B is in contact with the second inclined surface 81K of a corresponding one of the protrusions 81F.

As illustrated in FIG. 6, a flat spring 85 is provided on an upper portion of the second side portion 81C. The flat spring 85 is defined by (i) a slit 85A extending downward from a central portion of the upper portion of the second side portion 81C in the front and rear direction 6 and (ii) a slit 85B extending rearward from a lower end of the slit 85A. A projection 85D protruding leftward is provided on the surface 85C of the flat spring 85 which faces outward in the widthwise direction 8.

A front end portion of the flat spring 85 is movable in the widthwise direction 8, enabling contact of the projection 85D with the contact plate 60X provided on the third side surface 60G defining the recess 60M of the housing 60. When the projection 85D is brought into contact with the surface 60Y of the contact plate 60X, the flat spring 85 is elastically deformed toward a central portion of the cover 80 in the widthwise direction 8 and brought into pressing contact with the surface 60Y of the contact plate 60X. When the projection 85D is moved beyond the engagement edge 60W and brought into contact with the inclined surface 60U of the contact plate 60X, the projection 85D is brought into engagement with the engagement edge 60W.

A flat spring 85 similar in construction to the above-described flat spring 85 is provided on an upper portion of the first side portion 81B. A projection 85D provided on the flat spring 85 provided on the first side portion 81B is contactable with the surface 60Y and the inclined surface 60U of the contact plate 60X provided on the third side surface 60G defining the recess 60M of the housing 60. When the projection 85D is moved beyond the engagement edge 60W and brought into contact with the inclined surface 60U, the projection 85D is brought into engagement with the engagement edge 60W.

As illustrated in FIG. 5, upper end portions of the respective side-portion bodies 81E of the first side portion 81B and the second side portion 81C are coupled to each other by a coupler 81S provided on an upper and front end portion of the cover body 81.

As illustrated in FIG. 5, a plurality of first ribs 81W are provided on a front surface 81V of the base 81A of the cover body 81. Each of the first ribs 81W extends in the up and down direction 4 over the entire length of the base 81A in the up and down direction 4. The first ribs 81W are spaced apart from each other in the widthwise direction 8. Each of the first ribs 81W protrudes from the base 81A. Distal end faces 81Z of the respective first ribs 81W other than their respective upper portions are located on a virtual plane 44 extending substantially in the up and down direction 4 when the cover 80 is located at the standing position. The distal end faces 81Z located on the virtual plane 44 serves as a guide surface which guides the recording sheet 12 conveyed through the second conveyance path 52.

The upper portions of the distal end faces 81Z of the respective first ribs 81W are located on a virtual curved plane corresponding to the second curved path 52A of the second conveyance path 52. The distal end faces 81Z of the first ribs 81W serve as the guide surface for guiding the recording sheet 12 conveyed through the second conveyance path 52. This guide surface defines rear and upper portions of the second conveyance path 52.

A plurality of second ribs 81X each extending in the front and rear direction 6 are provided between an upper end portion of the base 81A and the coupler 81S disposed on the upper front end portion of the cover body 81. The second ribs 81X are spaced apart from each other in the widthwise direction 8. Upper edges of the respective second ribs 81X define the upper edge of the cover 80. Each of the second ribs 81X other than the second ribs 81X provided on a central portion of the cover body 81 in the widthwise direction 8 has an upper end face 81Y that is inclined upward with increase in distance from the coupler 81S. The upper end faces 81Y are located on the same virtual plane so as to serve as a guide surface (as one example of a second guide surface) which guides the pivoting distal end of the cover 80 with respect to the housing 60 when the cover 80 is pivoted to the standing position.

The upper end faces 81Y of the respective second ribs 81X are guided by the lower edge 60H of the first side surface 60D illustrated in FIG. 2B when the cover 80 is pivoted from the lying position to the standing position. Thus, the pivoting distal end of the cover 80 is smoothly guided into the back opening 60E, enabling smooth pivoting of the cover 80 to the standing position.

The cover body 81 is constituted by a single component formed of resin. In the present embodiment, the cover body 81 is formed of polystyrene (PS).

As illustrated in FIG. 7, the first resin member 82 is attached to the cover body 81 along the up and down direction 4. The first resin member 82 is disposed in front of the cover body 81 with a space therebetween. A rear surface of the first resin member 82 defines a front portion of the second conveyance path 52. A front surface of the second resin member 83 defines a rear portion of the first conveyance path 51.

When the cover 80 is located at the lying position, the first conveyance path 51 is exposed to the outside through the back opening 60E.

Operations of Cover 80

When the cover 80 is located at the standing position, as illustrated in FIG. 3, the engaging portions 81N provided respectively on front end portions of the first side portion 81B and the second side portion 81C are engaged with the respective positioners 68. The sliding contact surfaces 81U provided on the respective front end portions of the first side portion 81B and the second side portion 81C of the cover 80 are located on the respective support surfaces 69A of the supporters 69E provided on the housing 60.

The projections 85D of the flat springs 85 provided on the respective upper portions of the first side portion 81B and the second side portion 81C of the cover 80 are respectively held in pressing contact with the inclined surfaces 60U of the contact plates 60X that are respectively provided on the second side surface 60F and the third side surface 60G defining the recess 60M of the housing 60. In this state, these projections 85D are respectively engaged with the engagement edges 60W constituted by the surfaces 60Y and the inclined surfaces 60U of the respective contact plates 60X.

With the construction described above, the cover 80 is stably supported at the standing position.

In this state, each of the elongated holes 81G formed in the lower portions of the first side portion 81B and the second side portion 81C of the cover 80 extends in the up and down direction 4. Also, the shafts 66 for supporting the cover 80 are respectively located slightly above lower end portions of the respective elongated holes 81G In this state, the back opening 60E formed in the housing 60 is closed by the cover 80, and the first conveyance path 51 is defined by the front surface of the second resin member 83 of the cover 80. An upstream portion of the second conveyance path 52 in the conveying direction is defined at a rear end portion of the second supply tray 62. Thus, the upstream portion of the second conveyance path 52 is positioned with respect to the rear end portion of the second supply tray 62. This construction enables stable supply of the recording sheet 12 from the rear end portion of the second supply tray 62 to a predetermined position in the second conveyance path 52.

Figure 8:
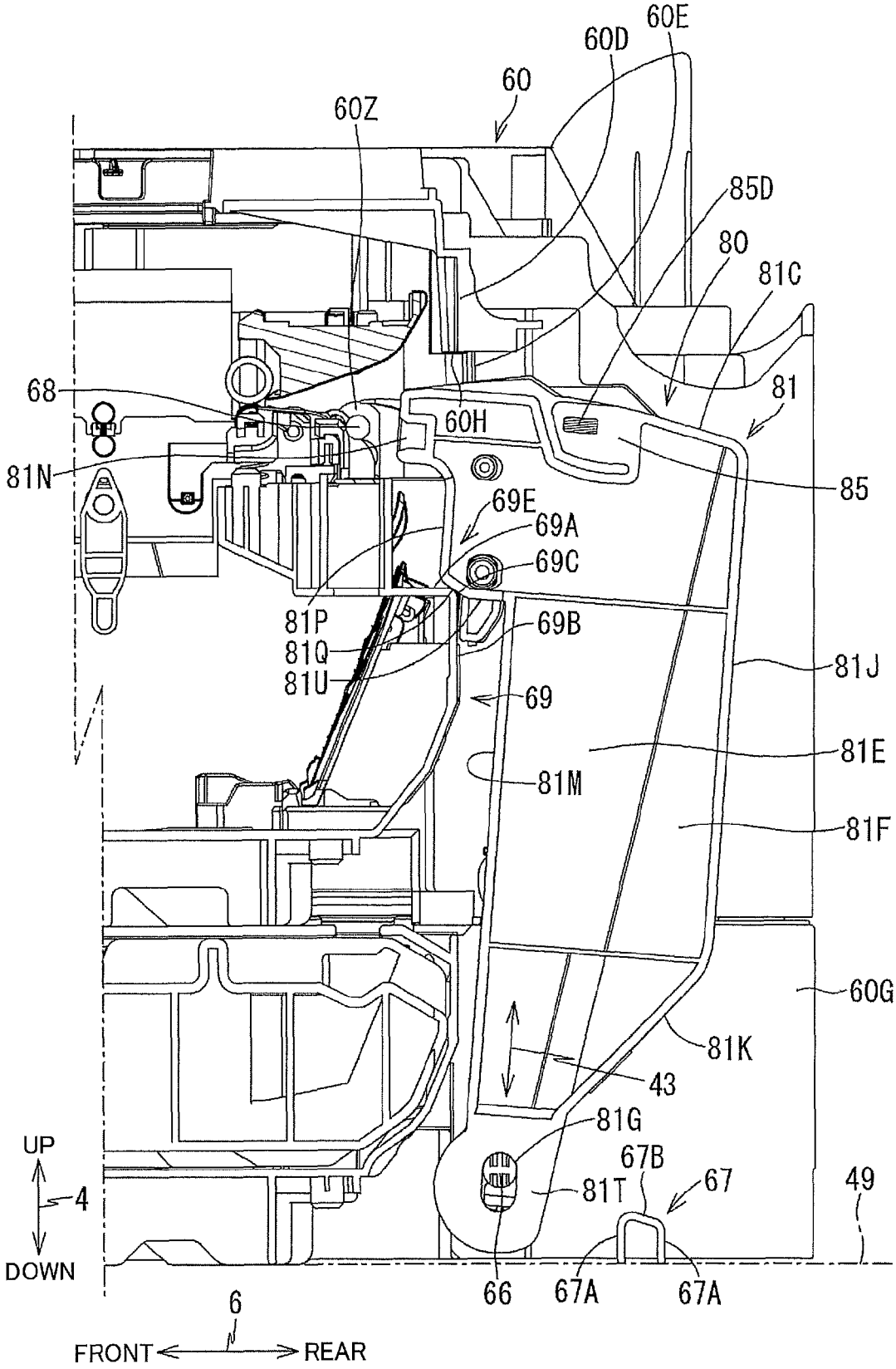
FIG. 8 is an elevational view in vertical cross section illustrating the rear end portion of the housing in a state in which the cover is pivoted rearward from the standing position.

In case where the back opening 60E need be exposed due to, e.g., paper jam in the first conveyance path 51 or the second conveyance path 52, the operator inserts his or her hand into the operation recess 81R of the cover 80 and pulls the cover 80 rearward. As a result, the projections 85D of the respective flat springs 85, which are held in contact with the surfaces 60Y of the respective contact plates 60X, are separated from the respective surfaces 60Y, and the cover 80 is pivoted so as to move the pivoting distal end rearward. This operation disengages the engaging portions 81N from the respective positioners 68 as illustrated in FIG. 8.

Upon this disengagement, the cover 80 is moved downward with respect to the shafts 66, so that the shafts 66 are respectively located at upper end portions of the respective elongated holes 81G i.e., end portions thereof nearer to the pivoting distal end of the cover 80 than the other end portions. After the engaging portions 81N are disengaged from the respective positioners 68, the cover 80 is inclined such that an upper end of the base 81A is located further toward the rear than a lower end thereof. Thus, the cover 80 is pivoted by its own weight about the shafts 66 such that the pivoting distal end moves downward. In this pivoting, the shafts 66 are not moved in the respective elongated holes 81G and accordingly the cover 80 is pivoted about the shafts 66 respectively located at the end portions of the respective elongated holes 81G which are located nearer to the pivoting distal end of the cover 80 than the other end portions. In this pivoting, the pivoting distal end of the cover 80 moves along a segment of a circle having a constant radius. The radius of the circle having the segment along which the pivoting distal end passes in this case is smaller than that of a circle having a segment along which the pivoting distal end passes when the shafts 66 are located at the lower end portions of the respective elongated holes 81G.

As illustrated in FIG. 9, the second inclined surfaces 81K of the respective protrusions 81F of the first side portion 81B and the second side portion 81C of the cover 80 are thereafter brought into contact with the contact surfaces 67B of the limiters 67 provided on the respective lower end portions of the second side surface 60F and the third side surface 60G of the housing 60. This contact inhibits the pivoting of the cover 80 about the shafts 66. Since this pivoting causes the pivoting distal end to move along the segment of the circle having the relatively short radius as described above, the cover 80 is brought into contact with the contact surfaces 67B of the respective limiters 67 relatively quickly.

When the second inclined surfaces 81K are brought into contact with the respective contact surfaces 67B of the limiters 67, reaction forces from the respective contact surfaces 67B act on the respective second inclined surfaces 81K. In this state, the longitudinal direction 43 of each elongated hole 81G is inclined with respect to the horizontal direction such that a height of the longitudinal direction 43 increases with decrease in distance to the pivoting distal end. Also, the shafts 66 are respectively located at the end portions of the respective elongated holes 81G which are located nearer to the pivoting distal end of the cover 80 than the other end portions. Accordingly, the cover 80 is movable along the longitudinal direction 43 of each elongated hole 81G in a direction away from the back opening 60E.

The center of gravity G1 of the cover 80 is farther from the shafts 66 than the second inclined surfaces 81K of the respective protrusions 81F. Thus, a moment acts on the contact surface 67B in a direction indicated by the arrow 46 by the weight of the cover 80. As a result, a reaction force against this moment is applied from the contact surfaces 67B to the respective second inclined surfaces 81K. This reaction force contains a force which moves the cover 80 along the longitudinal direction 43 of the elongated hole 81G in the direction away from the back opening 60E. This force along the longitudinal direction 43 slides the cover 80 in the direction away from the back opening 60E in a state in which the cover 80 is guided by the inclination of the contact surfaces 67B.

Figure 10:
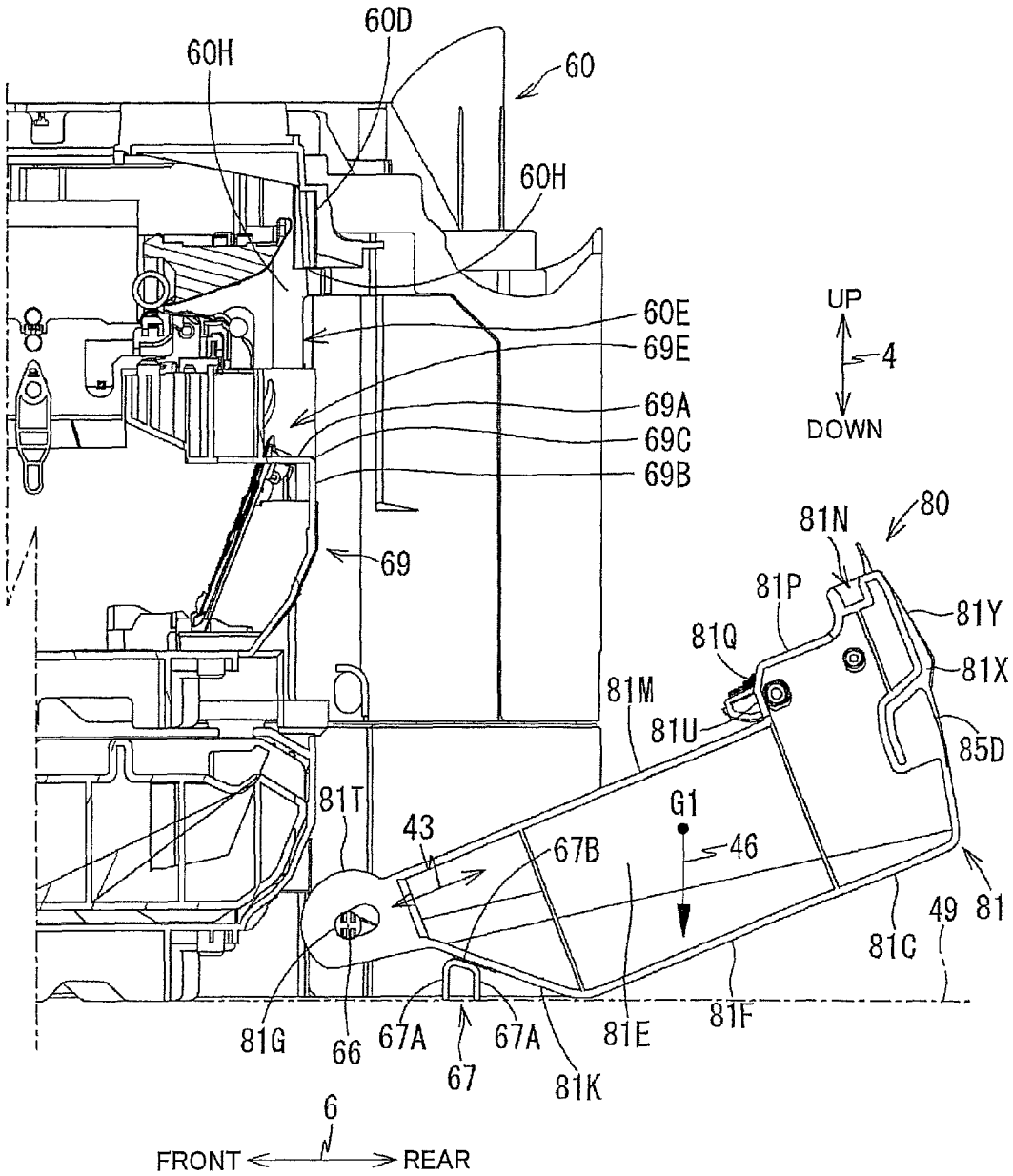
FIG. 10 is an elevational view in vertical cross section illustrating the rear end portion of the housing in a state in which the cover pivoted to the lying position is slid rearward.

As illustrated in FIG. 10, when the cover 80 is slid, the elongated holes 81G are slid relative to the respective shafts 66 in the longitudinal direction 43, so that the shafts 66 are positioned at the end portions of the respective elongated holes 81G which are located farther from the pivoting distal end of the cover 80. In this operation, the cover 80 is slid in the direction away from the back opening 60E in the state in which the second inclined surfaces 81K of the respective protrusions 81F of the cover 80 are in contact with the contact surfaces 67B of the respective limiters 67, and then the cover 80 is stopped. As a result, the cover 80 is spaced apart from the back opening 60E formed in the housing 60, that is, the back opening 60E is exposed, in the state in which the cover 80 is inclined. It is noted that the positions of the cover 80 in FIGS. 9 and 10 may be respectively referred to as "first lying position" and "second lying position".

When the cover 80 is pivoted to the lying position, the cover 80 is brought into contact with the limiters 67 and moved in the direction away from the back opening 60E. In this case, energy of pivoting the cover 80 to the lying position is converted into (i) impact generated due to the contact of the cover 80 with the limiters 67 and (ii) energy of moving the cover 80. This conversion reduces the impact generated due to the contact of the cover 80 with the limiters 67 when compared with the case where the cover 80 is not slid.

In the state illustrated in FIG. 10, a boundary portion between the first inclined surface 81J and the second inclined surface 81K of each protrusion 81F of the cover 80 is a lowermost portion of the cover 80, and as illustrated in FIG. 10 this lowermost portion is not in contact with the placement surface 49 on which the housing 60 is placed.

When the back opening 60E of the housing 60 is open, the first conveyance path 51 is exposed to the outside. This state enables the operator to remove paper jam in the first conveyance path 51 or the second conveyance path 52, for example.

In this state, the cover 80 is spaced apart from the back opening 60E because the cover 80 is slid in the direction away from the back opening 60E after contacting the limiters 67. This state facilitates the removal of the paper jam through the back opening 60E.

When the cover 80 is moved from the lying position illustrated in FIG. 10 to the standing position, the operator raises the pivoting distal end of the cover 80. In this operation, a forward force acts on the cover 80. This frontward force slides the elongated holes 81G relative to the respective shafts 66 in the longitudinal direction 43. In this slide, the shafts 66 are moved from the end portions of the respective elongated holes 81G which are located farther from the pivoting distal end of the cover 80, to the end portions of the respective elongated holes 81G which are located nearer to the pivoting distal end of the cover 80. In this state, the cover 80 is pivoted upward and frontward so as to move the pivoting distal end of the cover 80 toward the back opening 60E.

The respective first guide surfaces 81Q of the first side portion 81B and the second side portion 81C of the cover 80 are then opposed to the respective bent portions 69C of the supporters 69E provided on the housing 60.

When the cover 80 is pivoted in this state so as to move the pivoting distal end frontward, the first guide surfaces 81Q of the cover 80 are brought into contact with the respective bent portions 69C of the supporters 69E provided on the housing 60, so that the first guide surfaces 81Q are slid on the respective bent portions 69C. With this operation, the cover 80 is lifted while being pivoted so as to move the pivoting distal end frontward. As a result, the first guide surfaces 81Q of the cover 80 are positioned on the respective support surfaces 69A of the supporters 69E provided on the housing 60.

In this pivoting, the upper end faces 81Y of the respective second ribs 81X provided on the pivoting distal end of the cover 80 are brought into sliding contact with the lower edge 60H of the first side surface 60D which defines the upper edge of the back opening 60E. This sliding contact guides the upper end faces 81Y of the respective second ribs 81X to the lower edge 60H of the first side surface 60D. Since each of the upper end faces 81Y of the respective second ribs 81X is inclined so as to be higher at its rear portion than at its front portion, the upper end faces 81Y are guided by the lower edge 60H of the first side surface 60D, whereby the cover 80 is moved downward. Since the cover 80 is raised in this case, the elongated holes 81G are moved downward relative to the respective shafts 66, so that the shafts 66 are located at positions slightly above the lower end portions of the respective elongated holes 81G When the cover 80 is further pivoted so as to move the pivoting distal end frontward, the engaging portions 81N provided at the respective front end portions of the first side portion 81B and the second side portion 81C of the cover 80 are brought into engagement with the respective positioners 68 provided on the housing 60. In this state, the upper end faces 81Y of the respective second ribs 81X are spaced apart from and located under the lower edge 60H of the first side surface 60D. As a result, the cover 80 is positioned at the standing position.

In this state, the projections 85D of the flat springs 85 provided on the respective upper portions of the first side portion 81B and the second side portion 81C of the cover 80 are brought into sliding contact with the respective surfaces 60Y of the contact plates 60X and then brought into contact with the respective inclined surfaces 60U after moving beyond the respective engagement edges 60W. As a result, the projections 85D are engaged with the respective engagement edges 60W, whereby the cover 80 is stably supported at the standing position.

Effects

In the present embodiment, when the cover 80 is pivoted from the standing position to the lying position, the cover 80 is brought into contact with the contact surfaces 67B of the respective limiters 67 and moved along the inclination of the contact surfaces 67B in the direction in which the pivoting distal end of the cover 80 is moved away from the back opening 60E. This construction prevents direct collision of the cover 80 with the placement surface on which the housing 60 is placed, when the cover 80 is pivoted to the lying position. Furthermore, the movement of the cover 80 in the direction away from the back opening 60E reduces a possibility that the cover 80 interferes with removal of paper jam.

The limiters 67 protrude from the housing 60 and are in contact with the placement surface on which the housing 60 is placed. Thus, the limiters 67 are stably supported on the placement surface. This construction reduces deformation and breakage of the limiters 67 due to contact of the cover 80 with the limiters 67 when the cover 80 is pivoted from the standing position to the lying position.

The shaft 66 and the limiter 67 are provided on the bottom portion of a corresponding one of the second side surface 60F and the third side surface 60G of the housing 60. With this construction, the impact acting on the cover upon its contact with the limiters is divided, which reduces the impact on the cover. This reduction of the impact reduces a twisting force applied to the cover 80.

The cover 80 includes: the guide surface that guides the recording sheet 12 conveyed on the first conveyance path 51; the back surface 81D constituting a portion of the outer surface of the housing 60; and the protrusions 81F protruding rearward from the back surface 81D. This construction enables the cover 80 to define the first conveyance path 51, leading to smaller size of the MFP 10. Also, the impact caused upon contact of the cover 80 with the limiters 67 is absorbed by the protrusions 81F provided on the cover 80. Also, when the cover 80 is pivoted from the standing position to the lying position so as to move the pivoting distal end of the cover 80 in the direction away from the back opening 60E, the protrusions 81F provided on the cover 80 facilitate adjustment of a speed of the cover 80 and the height of the shafts 66, for example.

Each of the elongated holes 81G is elongated from the corresponding shaft 66 to the pivoting distal end in the state in which the cover 80 is located at the standing position. With this construction, when the cover 80 is pivoted from the standing position to the lying position, the pivoting distal end of the cover 80 is smoothly moved in the direction away from the back opening 60E.

The housing 60 includes the positioners 68 that are engaged with the cover 80 located at the standing position to position the cover 80 in the up and down direction 4. With this construction, the positioners 68 stably support the cover 80 at the standing position.

The engaging portions 81N engaged with the respective positioners 68 are guided by the respective first guide surfaces 81Q toward the respective positioners 68 in the process in which the cover 80 is pivoted from the lying position to the standing position. This guide facilitates positioning of the cover 80 when the cover 80 is pivoted from the lying position to the standing position.

The pivoting distal end of the cover 80 has the second guide surface that guides the cover 80 downward in the process in which the cover 80 is pivoted from the lying position to the standing position. This construction further facilitates the positioning of the cover 80 by the positioners 68.

Modifications

The cover 80 may not have the guide surface defining the second conveyance path 52. The guide surface defining the second conveyance path 52 is defined by the distal end faces 81Z of the respective first ribs 81W in the above-described embodiment and may be defined by a front surface of the cover body 81.

The cover 80 may be brought into contact with the placement surface on which the housing 60 is placed, when the cover 80 is moved by the limiters 67 in the direction away from the back opening 60E. This construction also prevents direct collision of the cover 80 with the placement surface on which the housing 60 is placed, when the cover 80 is pivoted to the lying position, resulting in reduction of impact on the cover 80, for example. In the above-described embodiment, the shafts 66 are provided on the respective bottom portions of the second side surface 60F and the third side surface 60G of the housing 60, and the elongated holes 81G are formed in the respective protruding portions 81T of the first side portion 81B and the second side portion 81C of the cover 80. However, the present disclosure is not limited to this construction. For example, the MFP 10 may be constructed such that the shafts 66 are provided on the respective protruding portions 81T of the first side portion 81B and the second side portion 81C of the cover 80, and the elongated holes 81G are formed in the respective bottom portions of the second side surface 60F and the third side surface 60G of the housing 60.

What is claimed is:

1. A sheet conveyor, comprising:

a housing defining therein a conveyance path along which a sheet is to be conveyed, the housing comprising a first side surface that has an opening;

a cover pivotable about a pivot axis between (i) a standing position at which the cover closes the opening and (ii) a lying position at which the cover exposes a portion of the conveyance path through the opening;

a shaft defining the pivot axis, the shaft being provided at one of the housing and the cover, and the other of the housing and the cover having an elongated hole through which the shaft is inserted; and a limiter provided immovably at the housing and comprising a contact surface configured to contact the cover when the cover pivots from the standing position to the lying position, wherein the contact surface is located below the shaft and comprises a first end and a second end that is closer to the conveyance path than the first end, and the contact surface is inclined with respect to a horizontal direction such that the first end is located below the second end, and wherein the cover is configured to slide down on the contact surface from the lying position in a direction away from the opening when the shaft relatively moves from one end toward the other end in a longitudinal direction of the elongated hole, the longitudinal direction being perpendicular to the pivot axis.

2. The sheet conveyor according to claim 1, wherein the shaft is provided at the housing, and wherein the elongated hole is formed in the cover.

3. The sheet conveyor according to claim 2, wherein when the cover is located at the standing position, a longitudinal direction of the elongated hole coincides with a direction directed from the shaft toward pivoting distal end of the cover.

4. The sheet conveyor according to claim 1, wherein the limiter protrudes from the housing and is configured to contact a placement surface on which the housing is placed.

5. The sheet conveyor according to claim 1, wherein the housing comprises a second side surface and a third side surface opposed to and spaced apart from each other in an axial direction of the shaft, and wherein the shaft and the limiter are provided at a bottom portion of each of the second side surface and the third side surface.

6. The sheet conveyor according to claim 1, wherein the cover comprises:

a guide surface configured to guide the sheet along the conveyance path;

a housing outer surface that is a portion of an outer surface of the housing; and a protrusion protruding from the housing outer surface and contactable with the contact surface of the limiter.

7. The sheet conveyor according to claim 1, wherein the housing comprises a positioner configured to be engaged with the cover located at the standing position to position the cover in a vertical direction.

8. The sheet conveyor according to claim 7, wherein the cover comprises an engaging portion configured to engage the positioner, and wherein the cover comprises a first guide surface configured to guide the engaging portion upward toward the positioner when the cover pivots from the lying position toward the standing position.

9. The sheet conveyor according to claim 8, wherein the housing comprises an edge defining, from above, the opening, and wherein the pivoting distal end of the cover comprises a second guide surface configured to contact the edge of the housing to guide the cover downward when the cover pivots from the lying position toward the standing position.

10. A sheet conveyor, comprising:

a housing defining therein a conveyance path along which a sheet is to be conveyed, the housing comprising a shaft and a side surface that has an opening;

a cover having an elongated hole through which the shaft of the housing is inserted, the cover being pivotable about the shaft between a standing position and a first lying position and movable from the first lying position to a second lying position, the cover being configured to, when at the standing position, close the opening and configured to, when at the first lying position, expose a portion of the conveyance path through the opening; and a limiter disposed immovably at the housing and comprising a contact surface configured to contact the cover when the cover pivots from the standing position to the first lying position, wherein the contact surface is located below the shaft of the housing and inclined with respect to a horizontal direction such that one end thereof farther from the opening is lower than the other end thereof closer to the opening, and wherein the cover is configured to, in response to contact of the contact surface with the cover, slide down on the contact surface from the first lying position to the second lying position in a direction away from the opening, such that a first end of the elongated hole moves away from the shaft and a second end of the elongated hole contacts the shaft, the first end being positioned between the second end and a pivoting distal end of the cover.

11. An image recording apparatus, comprising:

a sheet conveyor comprising (a) a housing defining therein a conveyance path along which a sheet is to be conveyed, the housing comprising a first side surface that has an opening, (b) a cover pivotable about a pivot axis between (i) a standing position at which the cover closes the opening and (ii) a lying position at which the cover exposes a portion of the conveyance path through the opening, (c) a shaft defining the pivot axis, the shaft being provided at one of the housing and the cover, and the other of the housing and the cover having an elongated hole through which the shaft is inserted, and (d) a limiter provided immovably at the housing and comprising a contact surface configured to contact the cover when the cover pivots from the standing position to the lying position; and an image recorder configured to record an image on the sheet conveyed along the conveyance path in the housing, wherein the contact surface is located below the shaft and comprises a first end and a second end that is closer to the conveyance path than the first end, and the contact surface is inclined with respect to a horizontal direction such that the first end is located below the second end, and wherein the cover is configured to slide down on the contact surface from the lying position in a direction away from the opening when the shaft relatively moves from one end toward the other end in a longitudinal direction of the elongated hole, the longitudinal direction being perpendicular to the pivot axis.

* * * * *